US008550819B2

(12) United States Patent
Anderson

(10) Patent No.: US 8,550,819 B2
(45) Date of Patent: Oct. 8, 2013

(54) MOTION TRAINING SCHEMATIC AND METHOD OF INSTRUCTION

(76) Inventor: Gary Anderson, Yalhaha, FL (US)

( * ) Notice: Subject to any disclaimer, the term of this patent is extended or adjusted under 35 U.S.C. 154(b) by 223 days.

(21) Appl. No.: 12/855,001

(22) Filed: Aug. 12, 2010

(65) Prior Publication Data

US 2012/0040317 A1 Feb. 16, 2012

(51) Int. Cl.
*A63B 15/00* (2006.01)
*A63B 69/36* (2006.01)
*A63B 69/00* (2006.01)

(52) U.S. Cl.
USPC ..... 434/252; 434/247; 434/257; 434/308; 473/218; 473/222; 473/266; 473/267

(58) Field of Classification Search
USPC ..... 434/247, 252, 257; 473/131, 151, 473/218, 219, 257, 261, 262, 264, 265, 266, 473/268, 270, 273, 278, 279
See application file for complete search history.

(56) References Cited

U.S. PATENT DOCUMENTS

| | | | | |
|---|---|---|---|---|
| 5,823,786 | A | 10/1998 | Easterbrook | |
| 5,823,878 | A | 10/1998 | Welch | |
| 5,904,484 | A | 5/1999 | Burns | |
| 5,911,635 | A * | 6/1999 | Ogden | 473/224 |
| 5,926,780 | A * | 7/1999 | Fox et al. | 702/142 |
| 6,126,449 | A * | 10/2000 | Burns | 434/252 |
| 6,322,455 | B1 * | 11/2001 | Howey | 473/168 |
| 6,514,081 | B1 | 2/2003 | Mengoli | |
| 6,786,730 | B2 * | 9/2004 | Bleckley et al. | 434/247 |
| 7,095,388 | B2 | 8/2006 | Truxa | |
| 7,192,359 | B1 | 3/2007 | Lundgren | |
| 7,283,647 | B2 | 10/2007 | McNitt | |
| 7,651,406 | B1 | 1/2010 | Yeh | |
| 8,371,954 | B1 * | 2/2013 | Anderson | 473/218 |
| 2001/0003104 | A1 * | 6/2001 | Binduga | 473/221 |
| 2005/0215338 | A1 | 9/2005 | Miyamoto | |
| 2006/0252018 | A1 | 11/2006 | Sooch | |
| 2009/0156321 | A1 | 6/2009 | Yeary | |
| 2010/0081116 | A1 * | 4/2010 | Barasch et al. | 434/252 |

* cited by examiner

*Primary Examiner* — Kathleen Mosser
*Assistant Examiner* — James Hull
(74) *Attorney, Agent, or Firm* — Daniel Law Offices, P.A.; Jason T. Daniel, Esq.

(57) ABSTRACT

A method of golf instruction utilizing a schematic represented by a plurality of vertical, diagonal and circular lines which demonstrate a preferred golf swing. A video recorder, processor and monitor can be used to record the golf swing of a student aligned within the schematic. Corrections to the students swing can be made based on the deviation from the schematic. Additionally, the flight path of the ball can be determined based upon the deviation from the schematic and the adjusted flight path can be displayed.

18 Claims, 16 Drawing Sheets

MOTION TRAINING SCHEMATIC AND METHOD OF INSTRUCTION

BACKGROUND

1. Field of the Invention

The present invention relates generally to golf instruction, and more particularly to a method for instructing a user to properly swing a golf club.

2. Description of the Related Art

The game of golf is one of the most difficult sports to master. In order to become proficient, players must learn to swing a golf club while maintaining proper body positioning, hand placement, club alignment and more. In this regard, golfers ranging from novice to professional often turn to professional instructors or commercially available products in order to analyze and correct swing mechanics.

There are a number of known video training systems available to aid a player in practicing their golf swing. Many of these systems superimpose a students golf swing over that of a single target player and focus on a specific attribute of the students' swing as compared to that of the master.

For example, U.S. Pat. No. 5,904,484 describes a video overlay generator to produce an image representing the technique of a master, and overlay the live image of the student for a simultaneous display on a visual monitor. While watching the overlying image of the master, the student attempts to execute his swing so as to maintain his image in alignment with the image of the master.

U.S. Pat. No. 6,514,081 describes a method for allowing a student to receive swing analysis by comparing target cues of a master that has been pre-recorded with those of a student. To this end, a video recording is made of the student performing the swing motion, and specific target queues, such as the wrists, are then compared to those of the master on a video monitor to allow the student to analyze differences between his swing motion and the master's swing motion.

U.S. Patent Publication No. 2006-0252018 describes an automated terminal which records a students golf swing and compares selected attributes (a student wears a sticker at predetermined locations) with an algorithm stored within the terminal in order to determine abnormal movement.

U.S. Pat. No. 5,823,878 describes a golf analysis method which uses videotape equipment to identify chosen points on the test subject. The points are compiled and used to calculate such parameters as clubhead lag and resultant clubhead velocity, body segment rotations, joint range of motion, spine angle, and center of mass versus center of pressure. Velocity data is used to calculate acceleration data. Such velocity and parameter data is then plotted simultaneously as part of an analysis method to determine and optimize the kinetic link between various body parts. Inefficiencies in each body segment motion can be addressed and corrected until an optimum kinetic link is achieved.

Although related to analysis of golf swings, none of the above methods allow a student to utilize a single technique/schematic capable of positioning and maintaining all aspects of the golfers body in a preferred position both before, during and after a golf swing. Additionally, by superimposing the student and master together, no leeway is provided and no explanation is given as to what effect each particular derivation will have on the resulting flight path of the golfball. Moreover, each of the above methods compares the student to a single master who may have swing mechanics that are not ideal.

Accordingly, it would be beneficial to provide a system and method of instruction that overcomes these deficiencies.

SUMMARY OF THE INVENTION

The present invention is directed to a method of golf instruction that includes a schematic represented by a plurality of vertical, diagonal and circular lines which demonstrate a preferred golf swing. One embodiment of the present invention can include a system for electronically teaching a user fundamentally ideal golf swings using the schematic. Another embodiment of the present invention can include a method for determining the flight path of the ball based upon a deviation from the schematic.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
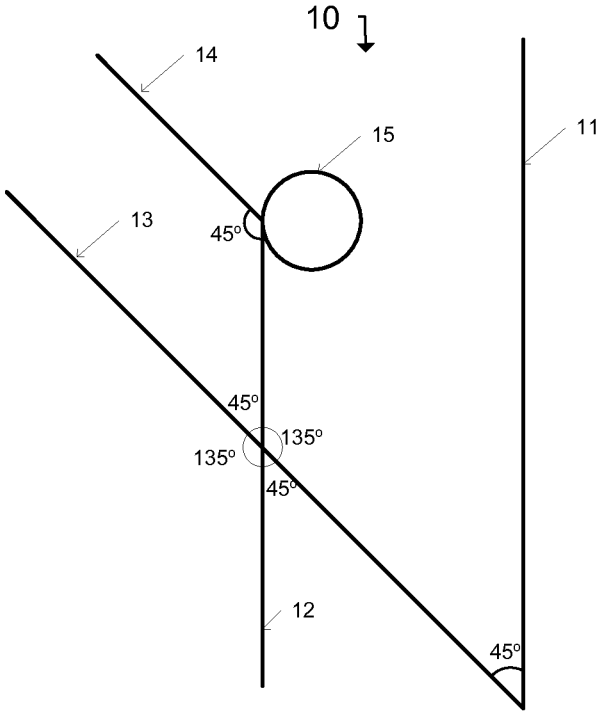
FIG. 1 is one illustration of a golf schematic 10 that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

As will be appreciated by one skilled in the art, aspects of the present invention may be embodied as a system, method or computer program product. Accordingly, aspects of the present invention may take the form of an entirely hardware embodiment or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The present invention can be used as an aid for teaching proper technique and muscle memory that is required to excel in various sports. Thus, although described below in the context of improving a golf swing, the scope and spirit of the invention can be equally utilized for instruction of other activities. Moreover, although described with particular reference to a right handed golfer, the inventive steps can also be utilized by a left handed golfer without deviating from the invention.

By systematically studying, recording and mapping the swing characteristics of a plurality of world-recognized professional golfers and golf instructors over a period of several years, the inventor has discovered a number of characteristics that are common to each. Based on these observations, ideal body positions and boundaries (as determined by the aggregate position of the above noted golfers) were identified and a golf schematic was created. As used herein, a golf schematic includes a mathematical compilation of ideal body positions, and a plurality of corresponding lines at identified angles used to connect each of these positions into a single map (schematic) representing the parameters for a fundamentally ideal golf swing.

To this end, and as will be explained in greater detail below, when a golfer performs a golf swing in accordance with the schematic, the ball will travel to the target area. Alternatively, when a golfer deviates from the schematic during a golf swing, the golf ball will deviate in a predictable manner that corresponds to the deviation from the schematic. As such, the system and method described herein can be utilized both as an aid for teaching new golfers proper technique, and by experienced golfers in order to diagnose unwanted deviations in their play.

FIG. 1 illustrates one embodiment of a golf schematic 10 that is useful for understanding the inventive concepts disclosed herein. Accordingly, golf schematic 10 can include: two vertical lines identified as a target line 11 and a posture line 12, two diagonal lines identified as a swing plane 13 and a body plane 14 and a circular line identified as a posture circle 15. As used herein, the target line 11 can represent the projected path the ball will travel when struck by the golfer. The posture line 12 can represent the preferred core body positioning of the golfer. The swing plane 13 can represent the lower boundary of the swing movement of the golfer. The body plane 14 can represent both the upper boundary of the swing movement of the golfer and the preferred upper body position of the golfer. Finally, the posture circle 15 can represent the preferred position of the head of the golfer.

As shown in FIG. 1, each element of the schematic is positioned at a specific location and angle with respect to the other elements. As such, the bottom end of the target line 11 is connected to the bottom end of the swing plane 13 at a 45° angle. The posture line 12 is positioned parallel to the target line 11 and is intersected at the mid point by the swing plane 13 at a 45° angle. The body plane 14 is positioned parallel to the swing plane 13 and is connected to the top of the posture line at a 45° angle. Finally, the posture circle 15 is positioned at the top of the posture line 12 nearest to the target line 11. This position and the identified angles act to ensure that a student golfer is maintaining proper body positioning at all times both before, during and after the golf swing.

In one preferred embodiment, the golf schematic 10 can be utilized in conjunction with a motion analysis system 20 as described below and shown in FIG. 2. However, other embodiments are also contemplated. For instance, in one alternative embodiment, golf schematic 10 can include a plurality of pipes/rods joined together to form a physical training rig having the shape illustrated in FIG. 1.

Figure 2:
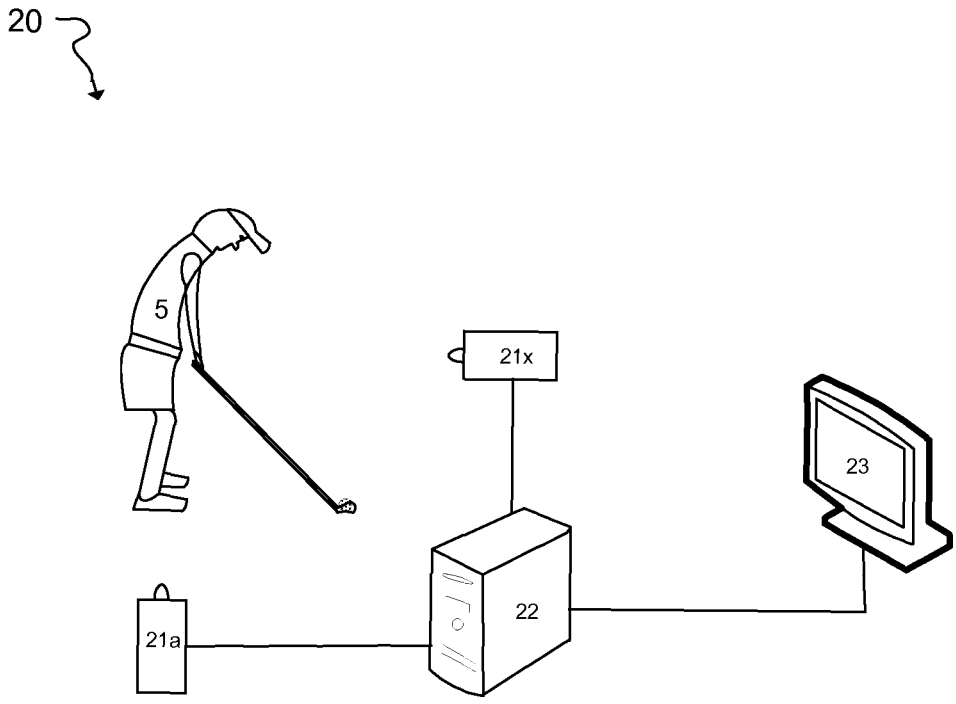
FIG. 2 is a block diagram of a motion training and analysis system in accordance with one embodiment of the present invention.

FIG. 2 illustrates one embodiment of a motion training and analysis system 20 in accordance with the inventive concepts disclosed herein. As shown, system 20 can include one or more recorders 21*a-x* connected to a computer 22 and a display 23 in order to capture the swing motion of a golfer 5.

As described herein, a recorder 21 can include any type of still or motion camera device such as a digital video recorder, which is capable of sufficiently capturing and transmitting (via wired or wireless means) images to the computer 12 in real time. In one embodiment, recorder 21 can be placed to observe a golfer 5 from behind, in a "down the line view" 21*a* or may be positioned to observe a golfer from a face view 21*x*. In an alternative embodiment, the plurality of recorders 21*a*-21*x* can be utilized together to simultaneously capture a golfer during a golf swing from multiple perspectives at one time.

Computer 22 can include a personal computer (PC) configured to run a commercially available operating system (such as WINDOWS, for example). Computers of this type are extremely well known in the art and include, among other well known elements, a central processing unit (CPU), a memory, a display 23, and a plurality of input/output (I/O) devices. To this end, recorders 21*a-x* can be connected to the computer 22 via the computer's I/O port so that images from the recorder can be stored on the memory of the computer.

Computer 22 can also be configured to generate the schematic 10 and produce the same on the display 23. In this regard, schematic 10 can be placed atop a live or still image of the golfer in order to allow an instructor to compare the body position of the golfer with that of the schematic. In one embodiment, the schematic can be displayed on the monitor 23 first, and then the student can be positioned by the instructor in a stance that is aligned within the schematic. Video and graphic programs capable of performing such actions are well known in the art, therefore no further description will be provided.

In one embodiment, display 23 can be connected to the computer 22 via a wireless means. As such, an instructor can stand anywhere in relation to the student and receive images in real time.

Figure 3:
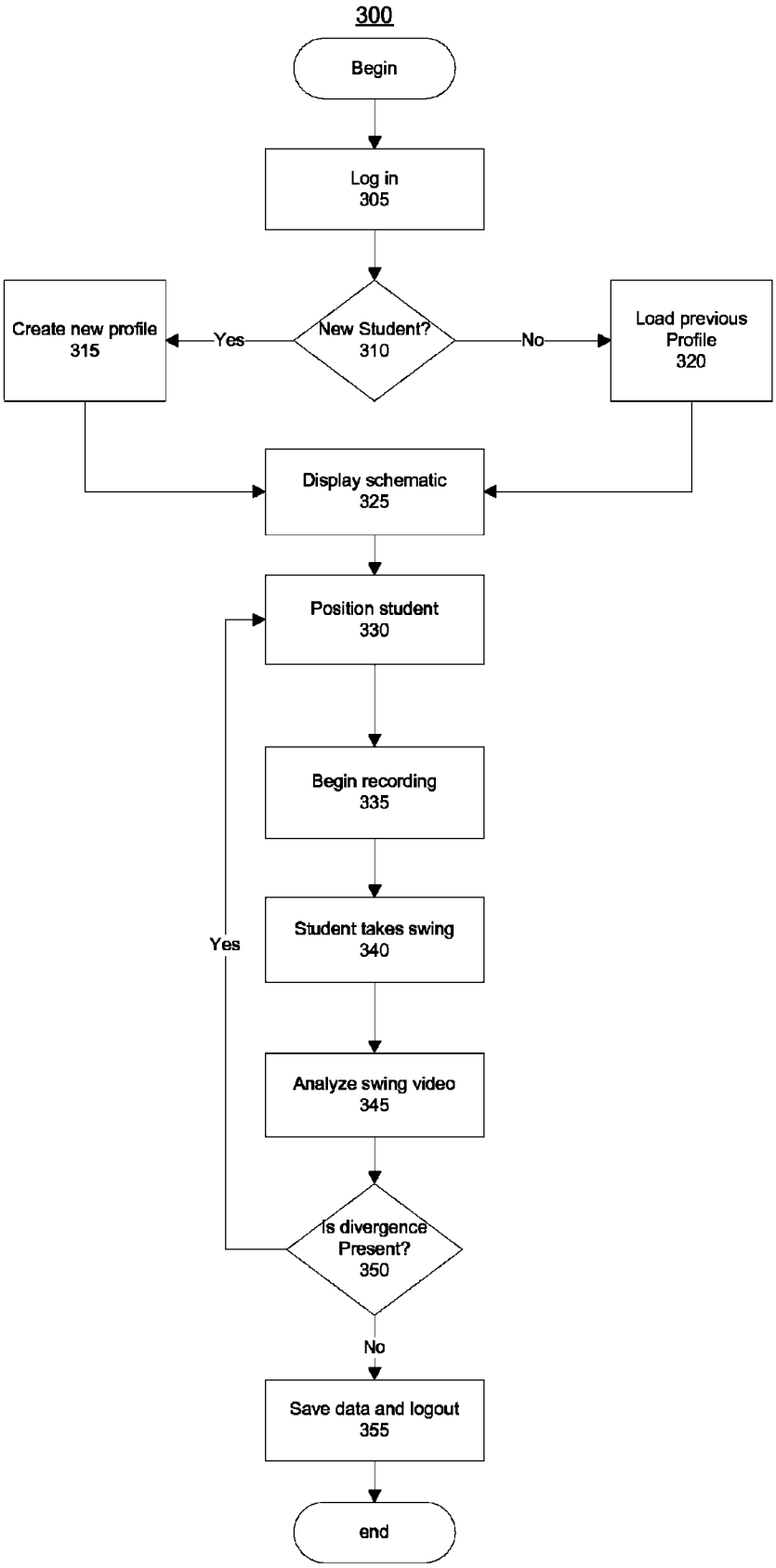
FIG. 3 is a flow chart illustrating a method of utilizing the golf schematic in accordance with one embodiment of the present invention.

FIG. 3 is a flow chart illustrating a method for instructing proper golf swing mechanics utilizing the golf schematic 10 and the motion training system 20 described above.

The method can begin at step 305 in which the instructor logs in to the computer. In step 310, the instructor determines if the student golfer is new or existing. If the student is new, the method proceeds to step 315 where a new profile is established. Alternatively, if the student is existing, the method proceeds to step 320 where the existing profile and previous lesson notes can be retrieved.

In step 325, one or more recorders are activated and the image of the lesson area is displayed on the screen along with the schematic.

In step 330, the student is instructed to enter the lesson area and take a setup position with reference to their club and the golf ball. At this time, the instructor can position the student inside the schematic as described below with reference to FIG. 4.

In step 335, the recorders begin recording, and in step 340 the student golfer swings the club at the ball.

In step 345, the instructor reviews the recording of the students' swing and analyzes the body location of the student at one or more predetermined positions (see FIGS. 5-11 below). To this end, the instructor can pause or play the recording of the swing in slow motion in order to identify the location of the student golfer in relation to the schematic.

In step 350, the instructor determines if the body movement of the student has diverged from that of the schematic at any of these (or other) positions, and if a divergence is identified, the method can return to step 330 for the student to correct the error in their next swing. However, if no divergence was identified and the instructor is satisfied with the progress of the student, the method can proceed to step 355 where the recorded information can be saved to a memory or database and the instructor can log out.

Although the analysis of the students' swing is described above as being conducted manually by an instructor, the invention is not so limiting. For instance, in one alternate embodiment, the swing analysis and determination of variance from the schematic can be performed automatically by the computer utilizing any number of commercially available software programs capable of tracking movement and/or detecting when a boundary is breached. To this end, the system can automatically alert the instructor (by changing the color of a portion of the schematic, for example) when the students' body movement conflicts with the schematic. One example of a conflicting body movement can include an instance in which the students body or the golf club crosses a boundary established by one line of the schematic.

Accordingly, steps 345 and 350 above can be autonomous if desired by the user.

As described above, the instructor can compare the student to the schematic at any number of predetermined swing positions. In one preferred embodiment, the predetermined swing positions can include: Setup, Takeaway, Upswing, Position at the top, Downswing, Impact, Follow through, and Finish.

Figure 4:
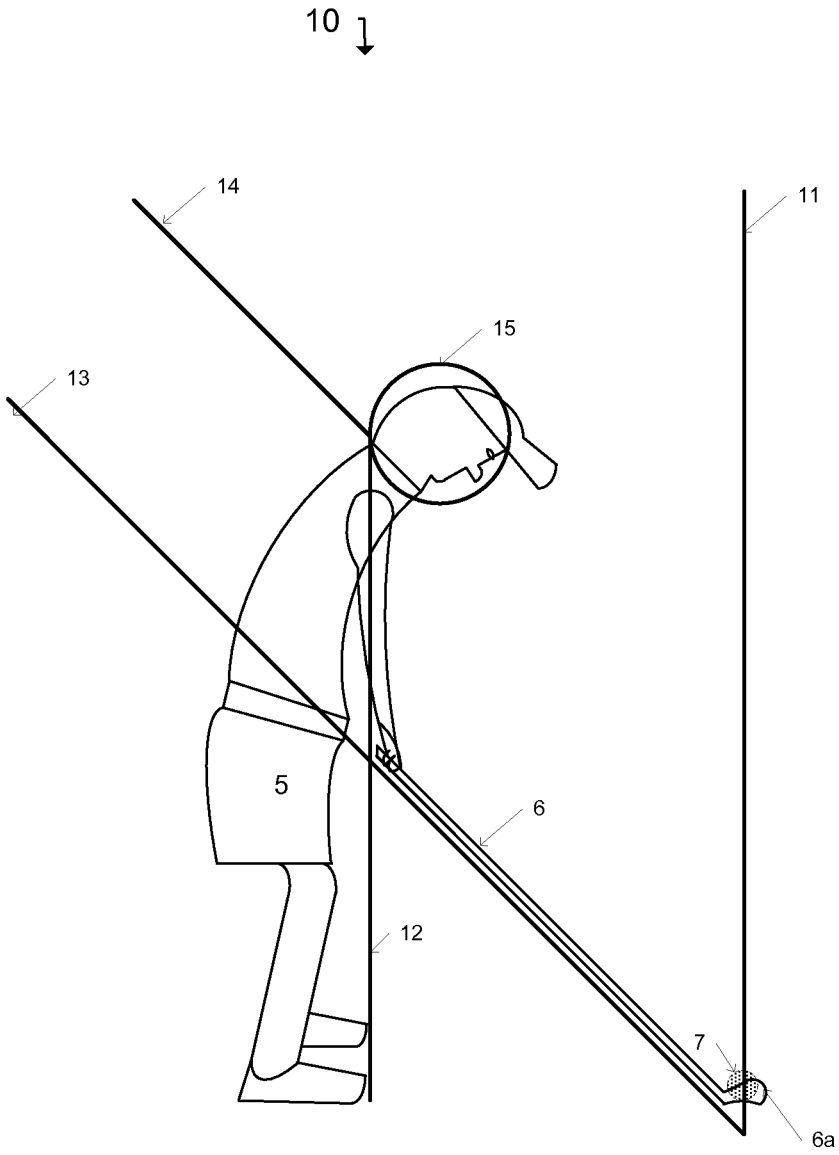
FIG. 4 is an illustration of a golfer using the schematic in a setup position in accordance with one embodiment of the present invention.

FIG. 4 illustrates one embodiment of a student golfer 5 positioned in a setup position according to the golf schematic 10. As shown, the student is positioned such that their shoulders, hips, knees, and feet are parallel to the target line 11, the top of the spine is aligned with the top of the posture line 12, the toes of the golfer are positioned at the bottom of the posture line 12, and the head of the golfer is positioned within the posture circle 15. Finally, the hands are positioned along the right side of the posture line 12, and the golf club 6 is positioned along the swing plane 13 such that the club face 6*a* is behind the ball 7 along the target line 11.

Figure 5:
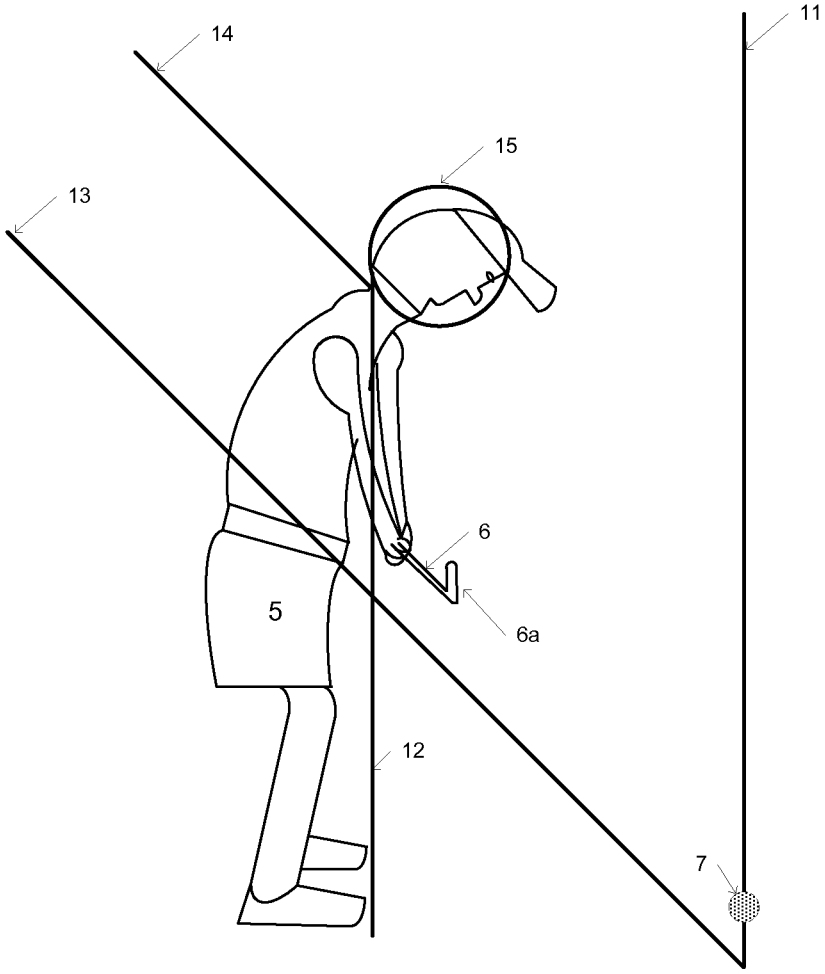
FIG. 5 is an illustration of a golfer using the schematic in a takeaway position in accordance with one embodiment of the present invention.

FIG. 5 illustrates one embodiment of a golfer 5 in the take away position. As described herein, the takeaway position can be the position in which the club is beginning the backswing motion. As shown, when aligned within the schematic 10, the left arm of the golfer remains parallel to the target line 11, the shoulders are at 45 degrees in relation to the ground. The top of the golfers spine is aligned with the top end of the posture line 12, and the toes of the golfer are positioned at the bottom end of the posture line 12. The head of the golfer is in the posture circle, and the club 6 is traveling upward parallel to the swing plane 13. Additionally, the club face 6*a* is positioned parallel to the target line 11 and the posture line 12.

Figure 6:
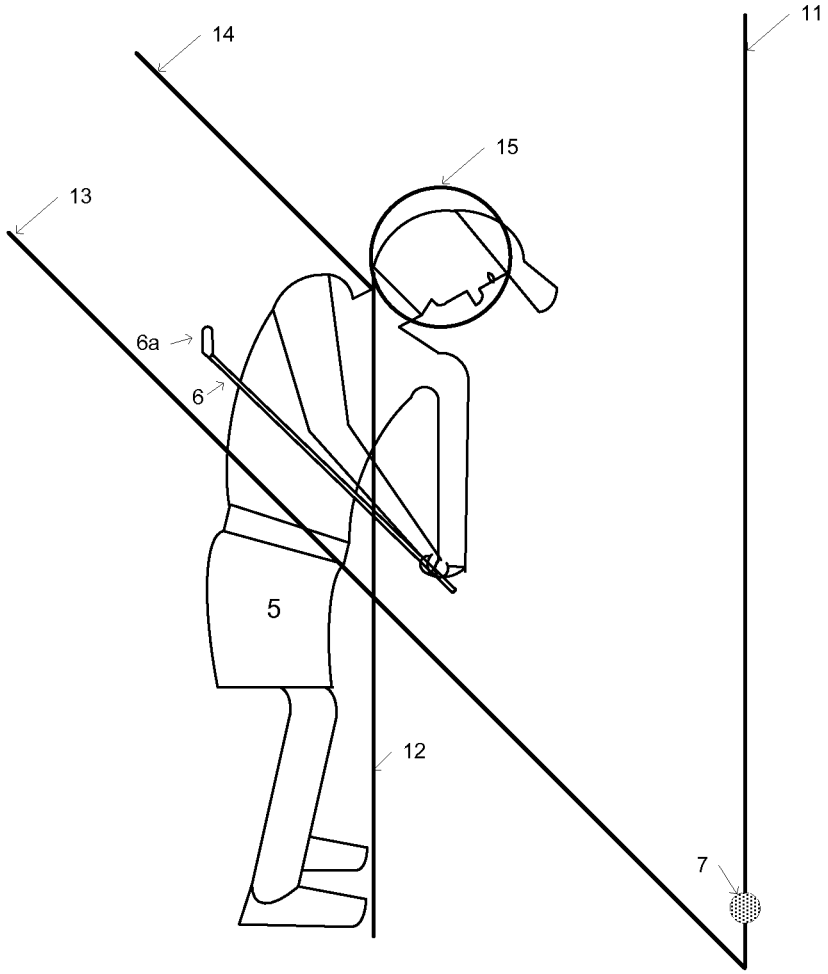
FIG. 6 is an illustration of a golfer using the schematic in a upswing position in accordance with one embodiment of the present invention.

FIG. 6 illustrates one embodiment of a golfer 5 in the upswing position. As described herein, the upswing position can be the position in which the club continuing along the backswing motion but has not yet reached the apex. As shown, when aligned within the schematic 10, the left arm of the student golfer remains parallel to the target line 11, the top of the golfers spine remains aligned with the top end of the posture line 12, and the toes of the golfer remain at the bottom end of the posture line. The head of the golfer remains in the posture circle 15, the club face 6*a* is parallel to the target line 11, and the club 6 travels upward in a parallel direction to both the swing plane 13 and the body plane 14.

Figure 7:
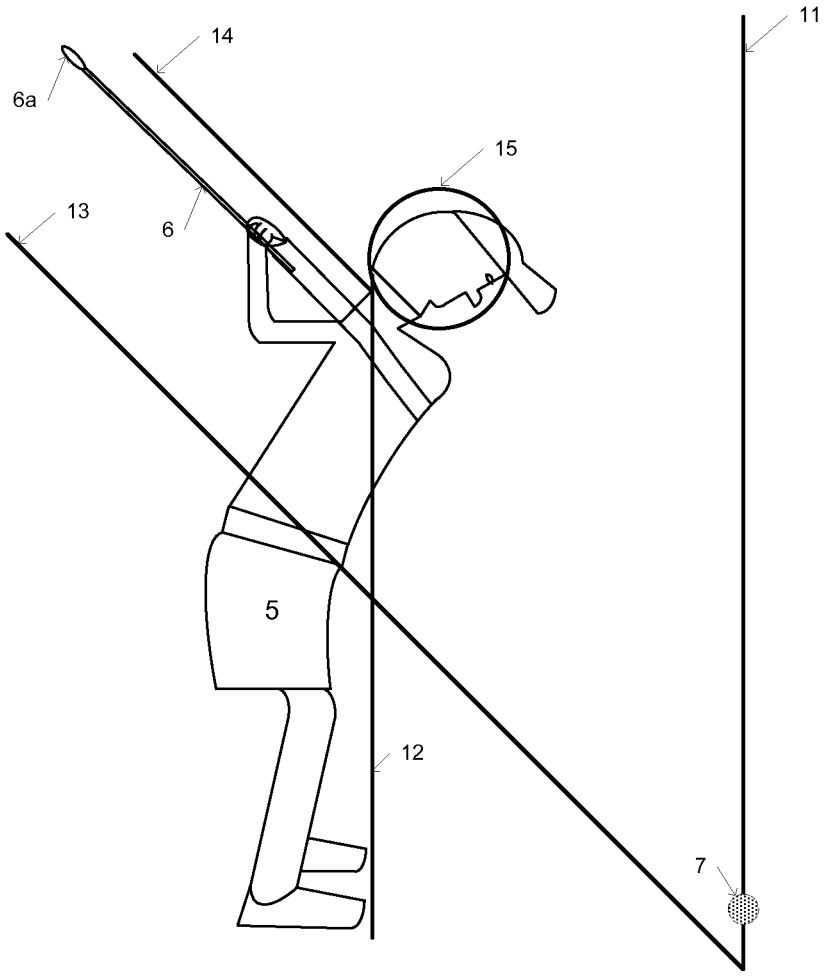
FIG. 7 is an illustration of a golfer using the schematic in a position at the top in accordance with one embodiment of the present invention.

FIG. 7 illustrates one embodiment of a golfer 5 in the position at the top. As described herein, the position at the top can be the apex of the upswing. As shown, when aligned within the schematic 10, the head of the student golfer remains in the posture circle 15, the top of the golfers spine remains aligned with the top end of the posture line 12, and the toes of the golfer remain at the bottom end of the posture line 12. Additionally, the club 6, the club face 6*a* and the left arm of the golfer remain parallel to the swing plane 13 and the body plane 14.

Figure 8:
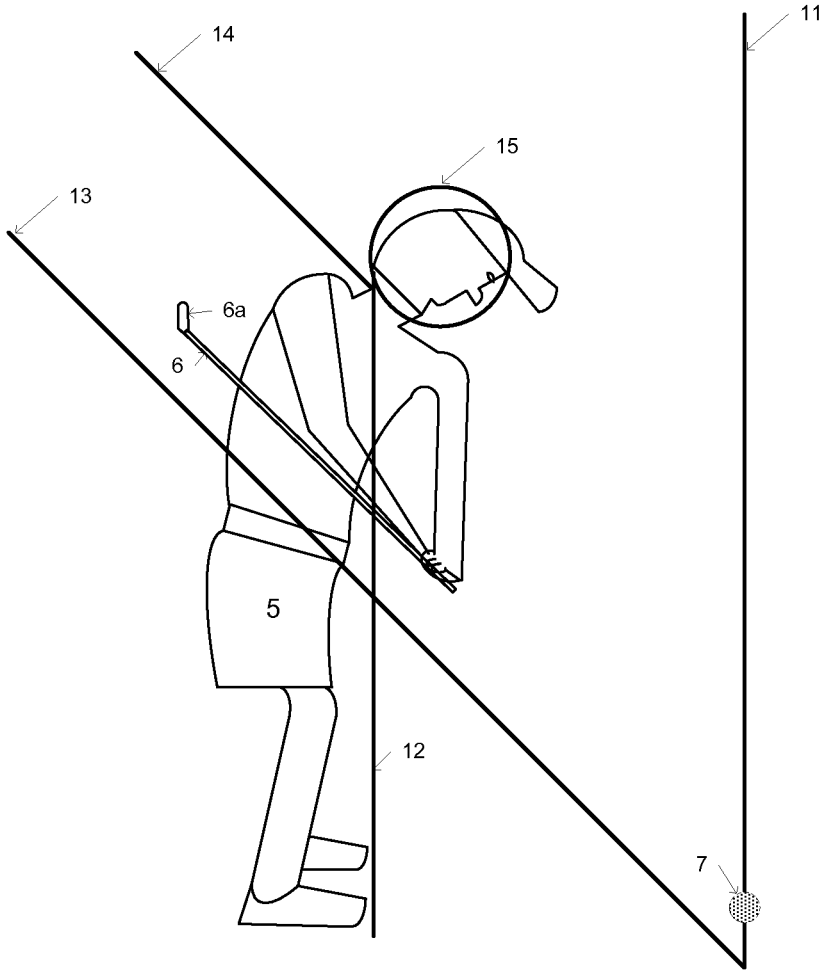
FIG. 8 is an illustration of a golfer using the schematic in a downswing position in accordance with one embodiment of the present invention.

FIG. 8 illustrates one embodiment of a golfer 5 in the downswing position. As described herein, the downswing position can be the position in which the club begins its downward motion en route to making contact with the ball 7. As shown, when aligned within the schematic 10, the left arm of the golfer is parallel to the target line 11, the top of the golfers spine remains aligned with the top end of the posture line 12, and the toes of the golfer remain at the bottom end of the posture line. The head of the golfer remains in the posture circle, and the club face 6*a* is parallel to the target line 11. Finally, the club 6 is located parallel to and equally spaced between the swing plane 13 and the body plane 14 as it travels downward.

Figure 9:
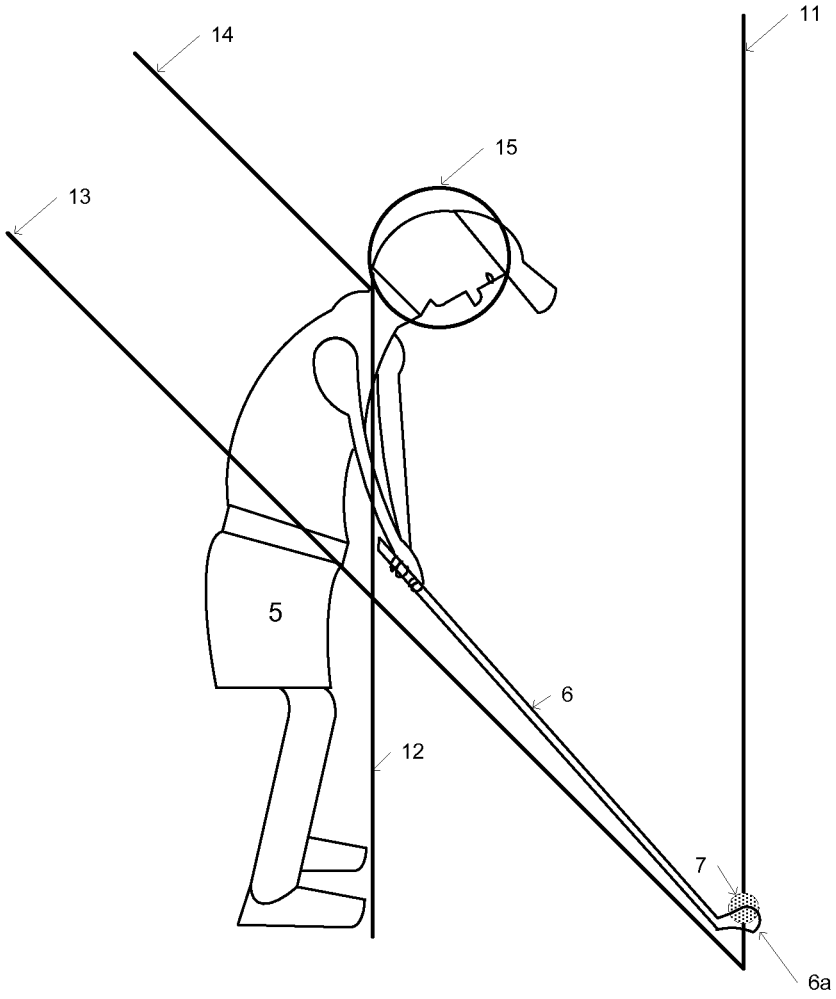
FIG. 9 is an illustration of a golfer using the schematic in an impact position in accordance with one embodiment of the present invention.

FIG. 9 illustrates one embodiment of a golfer 5 in the impact position. As described herein, the impact position can be the position in which the club face 6*a* makes contact with the ball 7. As shown, when aligned within the schematic 10, the golfer 5 is positioned such that their shoulders, hips, knees, and feet are parallel to the target line 11. The top of the golfers spine is aligned with the top end of the posture line 12, and the toes of the golfer are positioned at the bottom end of the posture line 12. The hands are positioned in front of the posture line 12, and the head of the golfer is positioned within the posture circle 15. Finally, the golf club 6 is positioned along the swing plane 13 such that the club face 6*a* is directly behind the ball 7 and the target line 11.

Figure 10:
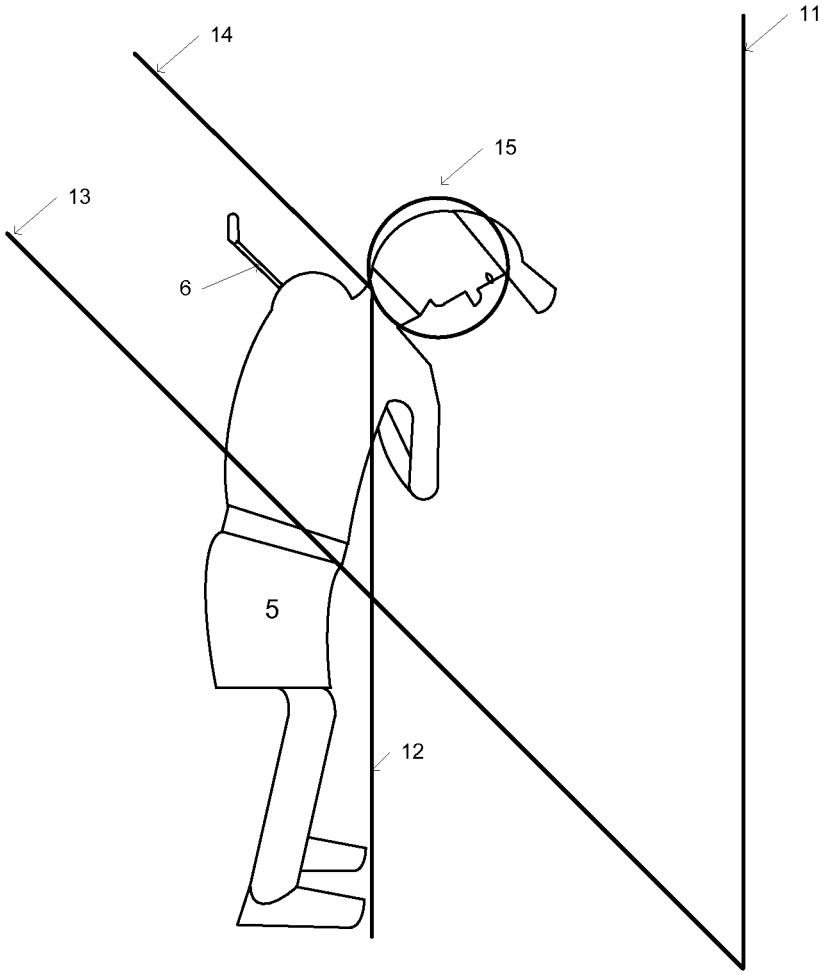
FIG. 10 is an illustration of a golfer using the schematic in a follow through position in accordance with one embodiment of the present invention.

FIG. 10 illustrates one embodiment of a golfer 5 in the follow through position. As described herein, the follow through position can be the position in which the clubhead has already struck the ball. As shown, when aligned within the schematic 10, the student golfer 5 is positioned such that the head remains inside the posture circle 15, the top of the golfers spine is aligned with the top end of the posture line 12, and the toes of the golfer are positioned at the bottom end of the posture line 12. Additionally, a majority of the right arm and club 6 are positioned parallel to both the target line 11 and the posture line 12.

Figure 11:
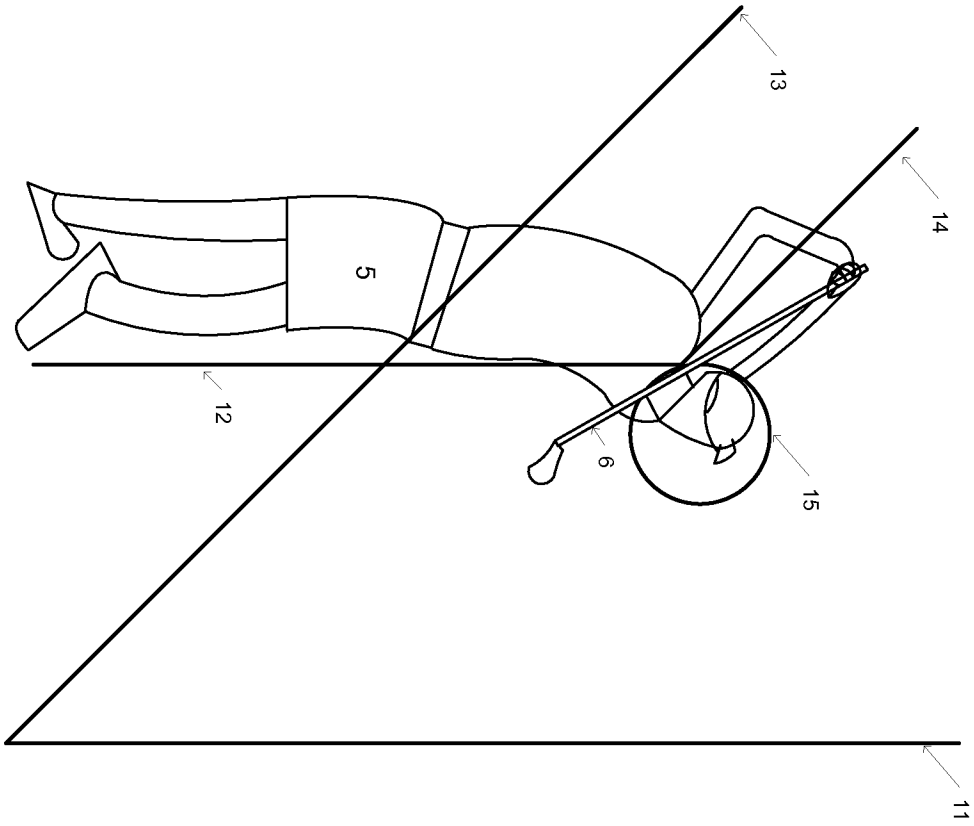
FIG. 11 is an illustration of a golfer using the schematic in a finish position in accordance with one embodiment of the present invention.

FIG. 11 illustrates one embodiment of a golfer 5 in the finish position. As shown, when aligned within the schematic 10, the golfer 5 is positioned such that the head remains inside the posture circle, the top of the golfers spine is aligned with the top end of the posture line 12, and the toes of the golfer are positioned at the bottom end of the posture line 12. The majority of the left arm is below the body plane 14 and is bent at the elbow resulting in the forearm portion being perpendicular to the body plane 14, and both the right arm and club 6 are positioned parallel to and above the body plane 14.

By aligning the swing of the student golfer to that of the schematic, as described above, it is possible to teach a novice golfer fundamentally sound swing mechanics while also providing visual feedback throughout the learning process. Additionally, the inventive concepts disclosed herein can be equally utilized to analyze the swing of an intermediate to experienced golfer in order to determine the cause of poor play.

Owing to the reciprocal mathematic relationship between any divergence from the schematic during a swing, and the resulting flight of the golf ball, it becomes possible for an instructor to determine where the ball will travel before the student completes their swing based solely upon the percentage of deviation from the schematic. For instance, in one embodiment, when the body or club of a golfer deviates 10 degrees in one direction from the schematic, the resulting flight of the golf ball will deviate 10 degrees from the target line. Of course, if the golfer deviates by a greater or lesser percentage, the flight of the ball will also deviate by a corresponding amount, as described further by the examples embodied in FIGS. 12-16 below.

Figure 12:
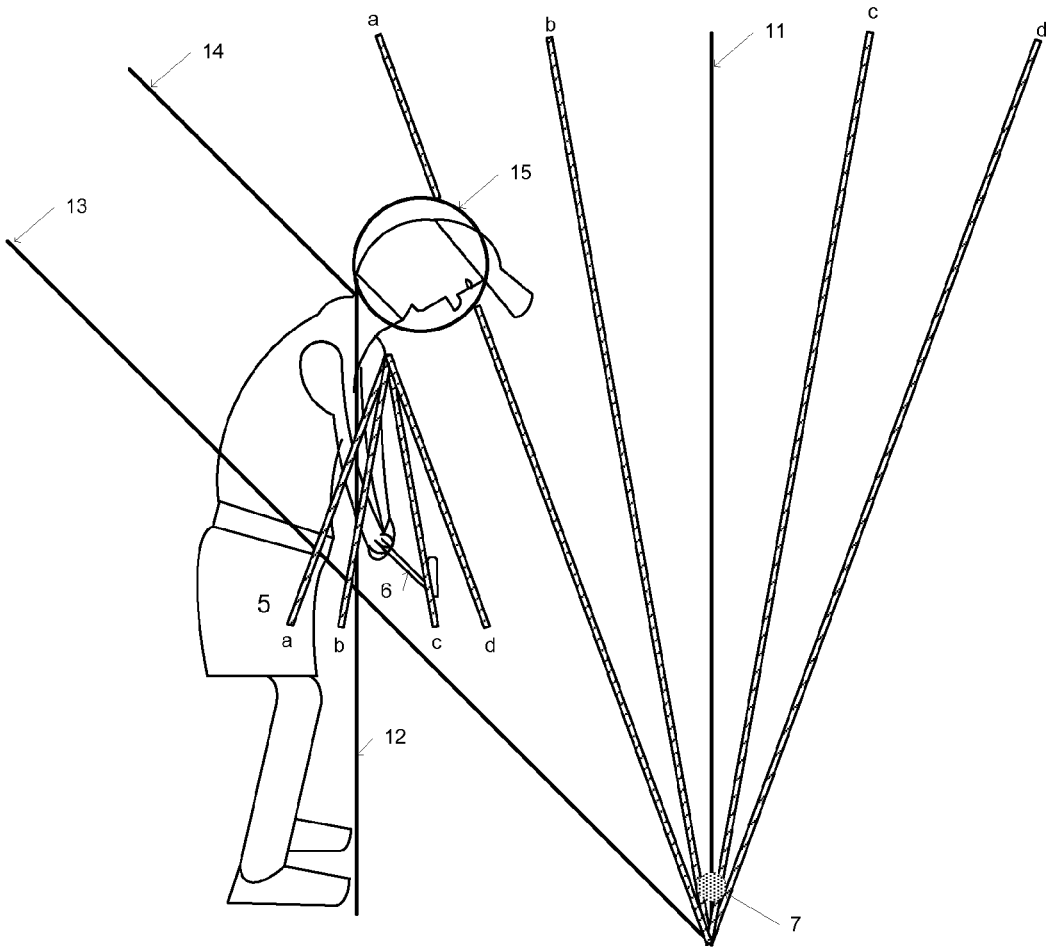
FIG. 12 is an illustration of a golfer using the schematic in a takeaway position in accordance with another embodiment of the present invention.

FIG. 12 illustrates one embodiment of a golfer 5 in the takeaway position. As described above with reference to FIG. 5, the left arm of the golfer should be positioned parallel to the target line 11. However, when the left arm deviates from this position (in this example, deviations a, b, c, and d are in increments of 15 degrees) the resulting flight of the ball 7 will also deviate from the target line 11 by the same percentage of deviation.

Figure 13:
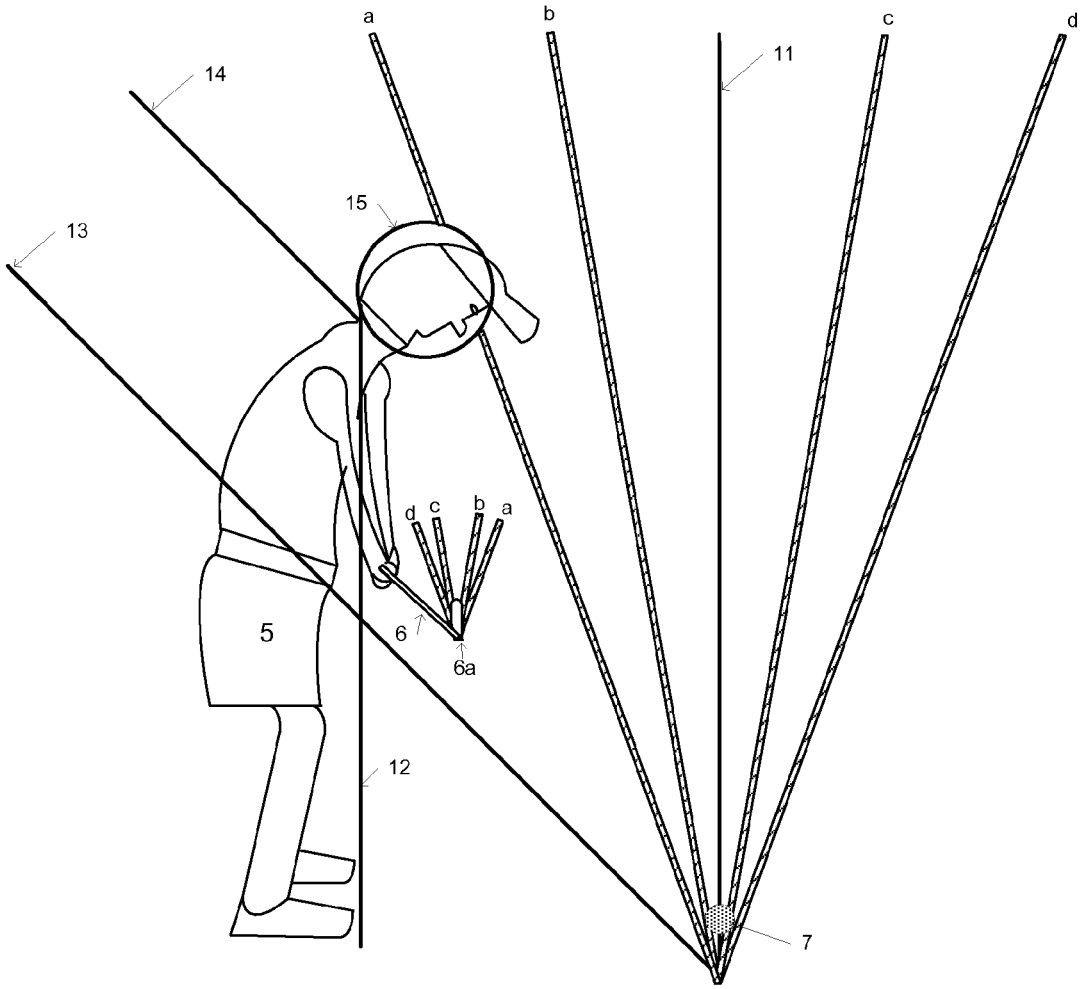
FIG. 13 is an illustration of a golfer using the schematic in a takeaway position in accordance with yet another embodiment of the present invention.

FIG. 13 illustrates another embodiment of a golfer 5 in the takeaway position. As described above with reference to FIG. 5, the club face 6*a* should be positioned parallel to the target line 11. As such, any deviation a-d will result in a corresponding deviation of the flight of the ball 7 from the target line 11.

Figure 14:
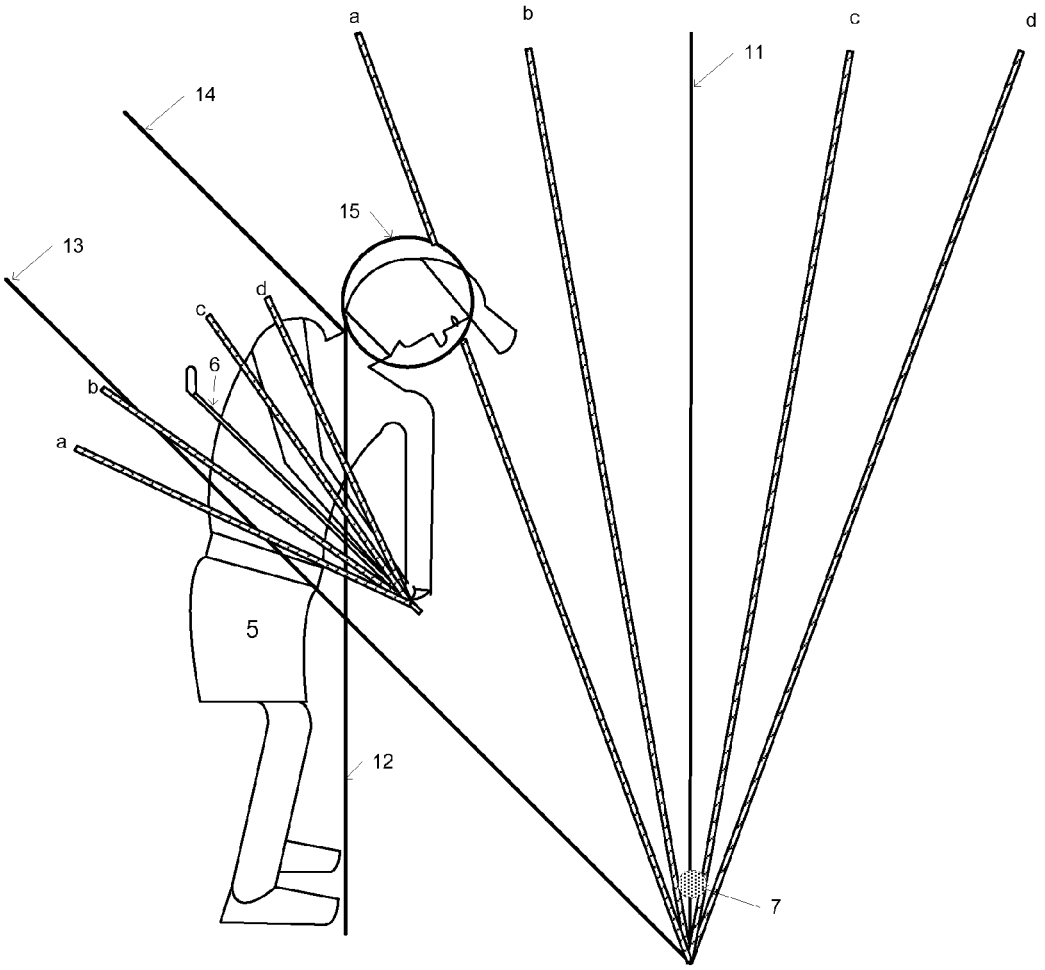
FIG. 14 is an illustration of a golfer using the schematic in a upswing position in accordance with another embodiment of the present invention.

FIG. 14 illustrates one embodiment of a golfer 5 in the upswing position. As described above with reference to FIG. 6, the club 6 should travel upward in a parallel direction to both the swing plane 13 and the body plane 14. However, when the club deviates from this position (see a-d) the resulting flight of the ball 7 will deviate from the target line 11 by the same percentage of deviation.

Figure 15:
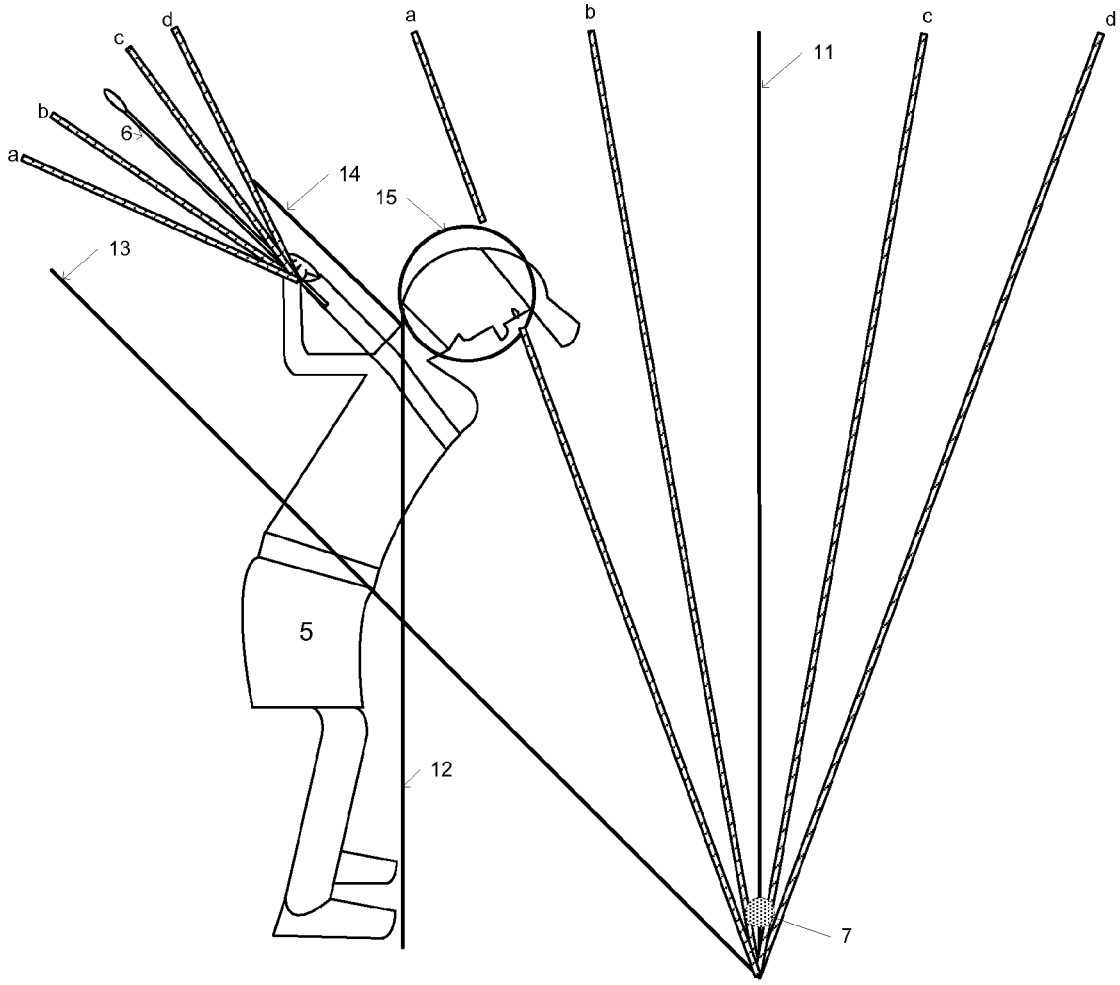
FIG. 15 is an illustration of a golfer using the schematic in a position at the top in accordance with another embodiment of the present invention.

FIG. 15 illustrates one embodiment of a golfer 5 in the position at the top. As described above with reference to FIG. 7, the club 6 should remain parallel to the swing plane 13 and the body plane 14. However, when the clubhead deviates from this position (see a-d) the resulting flight of the ball 7 will deviate from the target line 11 by the same percentage of deviation.

Figure 16:
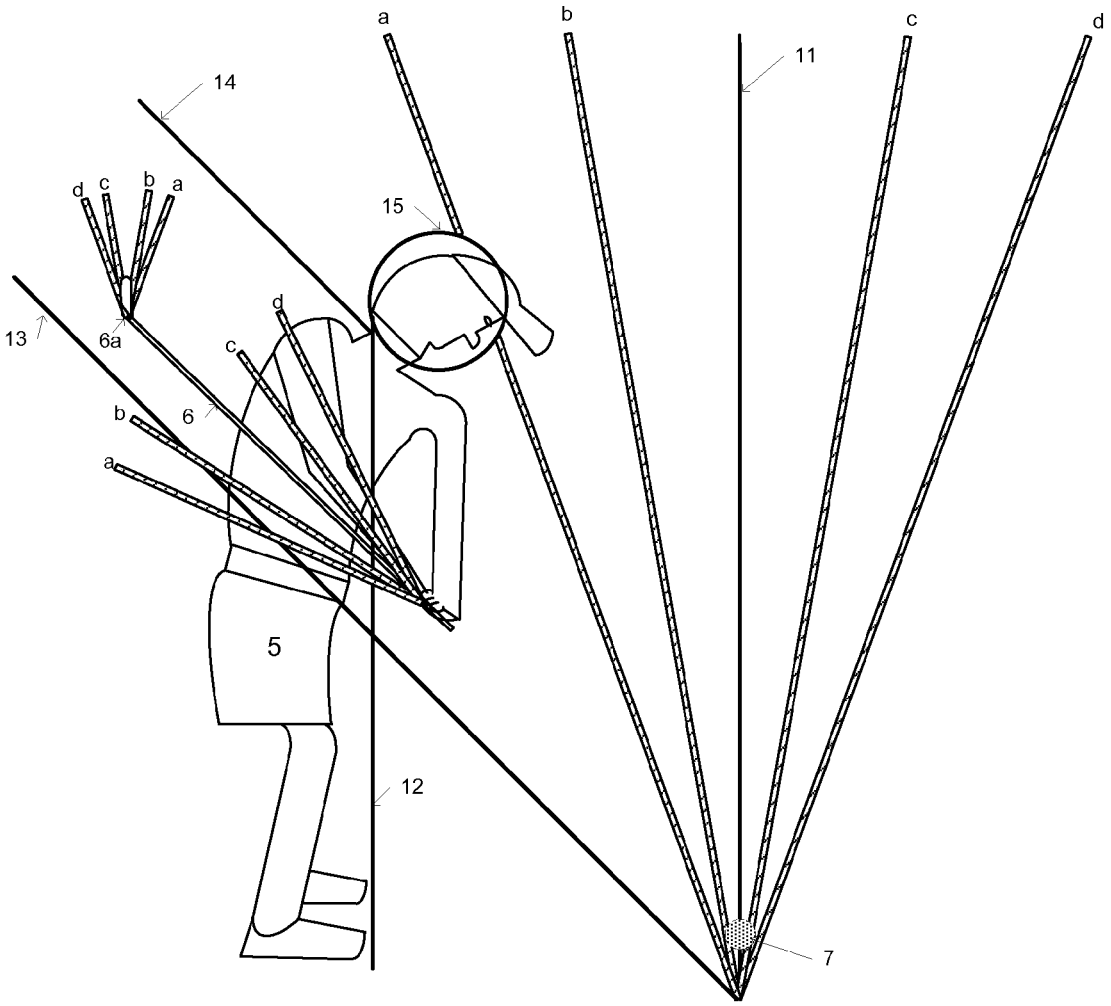
FIG. 16 is an illustration of a golfer using the schematic in a downswing position in accordance with another embodiment of the present invention.

FIG. 16 illustrates one embodiment of a golfer 5 in the downswing position. As described above with reference to FIG. 8, the club 6 should travel downward in a parallel direction to both the swing plane 13 and the body plane 14, and the club face 6*a* should remain parallel to the target line 11. However, when either the club 6 or club face 6*a* deviates from this position (see a-d) the resulting flight of the ball 7 will deviate from the target line 11 by the same percentage of deviation.

The method and system described above can thus be utilized to teach or improve the golf swing of a user. As such, the system can identify when the student golfer deviates from the schematic (i.e. by changing the color of the portion of the schematic, for example) and based on this deviation, the system can calculate a percentage of deviation. To this end, in one embodiment, if the student is in the downswing position and the club is not parallel to the swing plane, the system can determine the actual angle of the club, and then compare that number to the target number in order to determine a percentage of deviation. This percentage can then be used to calculate an adjusted target line (i.e. such as lines a-d in FIGS. 12-16 above) which can be displayed on the screen 23 as the projected path of the flight of the ball. Such a feature can be particularly useful in instances where the golfer can not actually hit a real golf ball (such as an indoor training facility, for example).

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A system for analyzing a swing motion of a student, said system comprising:

one or more image capture devices, each device being configured to record the swing motion of a student;

a processing unit connected to the one or more image capture devices, said processing unit being configured to generate a schematic and to superimpose the schematic onto a portion of the recording, wherein the schematic is a static graphical representation configured to indicate information therefrom throughout, and subsequent to, the swing motion;

a memory configured to store the schematic and the recording; and a monitor configured to display the schematic and the recording, wherein said schematic represents a preferred swing stance and includes:

a first and second vertical line connected by a first diagonal line, said first diagonal line being connected to a bottom end of the first vertical line at a 45 degree angle and intersecting the second vertical line at a midpoint location, wherein the second vertical line is superimposed at a preferred core body position of the student, a circle connected to a top end of the second vertical line and extending toward the first vertical line, and a second diagonal line connected to the top end of the second vertical line and extending in a direction opposite to the first vertical line and parallel to said first diagonal line.

2. The system for analyzing swing motion of claim 1, wherein said processor unit is configured to notify a user when a portion of a students' body crosses a line of the schematic.

3. The system for analyzing swing motion of claim 2, wherein said notification includes changing a color of the portion of the schematic that was crossed by the student.

4. The system for analyzing swing motion of claim 1, wherein said one or more image capture devices include a digital video recorder.

5. The system for analyzing swing motion of claim 1, wherein at least one of said image capture devices is positioned in a down the line position.

6. The system for analyzing swing motion of claim 1, further comprising:

a physical training rig consisting of the schematic positioned behind the user.

7. The system for analyzing swing motion of claim 1, wherein said monitor is wirelessly connected to the processor.

8. A method for analyzing a swing motion of a student, said method comprising:

capturing a lesson area via a recorder and displaying the same on a monitor;

generating, via a processor, a schematic on the monitor, wherein said schematic is a static graphical representation configured to indicate information therefrom throughout, and subsequent to, the swing motion and represents a preferred swing stance and includes: a first and second vertical line connected by a first diagonal line, wherein the second vertical line is superimposed at a preferred core body position of the student, said first diagonal line being connected to a bottom end of the first vertical line at a 45 degree angle and intersecting the second vertical line at a midpoint location, a circle connected to a top end of the second vertical line and extending toward the first vertical line, and a second diagonal line connected to the top end of the second vertical line and extending in a direction opposite to the first vertical line and parallel to said first diagonal line;

arranging the body of a student into a setup position within the schematic on the lesson area;

recording a swing motion of the student; and comparing the swing motion of the student to the schematic.

9. The method for analyzing swing motion of a student of claim 8 wherein said comparing is performed by a human instructor.

10. The method for analyzing swing motion of a student of claim 8 further comprising:

notifying a user when a portion of a students' body crosses a line of the schematic.

11. The method for analyzing swing motion of a student of claim 10 further comprising:

changing a color of the portion of the schematic that was crossed by the student.

12. The method for analyzing swing motion of a student of claim 8 further comprising:

notifying the student where they deviated from the schematic.

13. The method for analyzing swing motion of a student of claim 12 further comprising:

instructing the student how to correct their swing motion based on the notification.

14. A method for determining a flight path of a ball based on a swing motion of a student, said method comprising:

capturing a lesson area via a recorder and displaying the same on a monitor;

generating, via a processor, a schematic on the monitor, wherein said schematic is a static graphical representation configured to indicate information therefrom throughout, and subsequent to, the swing motion and represents a preferred swing stance and includes:

a first and second vertical line connected by a first diagonal line, said first diagonal line being connected to a bottom end of the first vertical line at a 45 degree angle and intersecting the second vertical line at a midpoint location, wherein the second vertical line is superimposed at a preferred core body position of the student, a circle connected to a top end of the second vertical line and extending toward the first vertical line, and a second diagonal line connected to the top end of the second vertical line and extending in a direction opposite to the first vertical line and parallel to said first diagonal line;

arranging the body of a student into a setup position within the schematic on the lesson area;

recording a swing motion of the student;

identifying a portion of the students' swing motion that deviates from the schematic;

calculating a percentage of deviation based on the identification;

calculating a projected flight path of the ball based upon the percentage of deviation; and inserting an adjusted target line into the schematic, said adjusted target line representing the calculated path of the ball.

15. The method for determining a flight path of a ball based on the swing motion of a student of claim 14, wherein said identifying is performed by a human instructor.

16. The method for determining a flight path of a ball based on the swing motion of a student of claim 14, wherein said identifying is performed by the processor.

17. The method for determining a flight path of a ball based on the swing motion of a student of claim 14, wherein said calculating a percentage of deviation based on the identification is performed by the processor.

18. The method for determining a flight path of a ball based on the swing motion of a student of claim 14, further comprising:

notifying the student where they deviated from the schematic.

* * * * *